US011261692B2

(12) United States Patent
Li et al.

(10) Patent No.: US 11,261,692 B2
(45) Date of Patent: Mar. 1, 2022

(54) METHOD AND APPARATUS FOR IDENTIFYING AND REMEDIATING LOSS CIRCULATION ZONE

(71) Applicant: Saudi Arabian Oil Company, Dhahran (SA)

(72) Inventors: Bodong Li, Dhahran (SA); Chinthaka Pasan Gooneratne, Dhahran (SA); Guodong Zhan, Dhahran (SA); Timothy Eric Moellendick, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/849,607

(22) Filed: Apr. 15, 2020

(65) Prior Publication Data

US 2021/0324702 A1 Oct. 21, 2021

(51) Int. Cl.
*E21B 33/13* (2006.01)
*E21B 47/017* (2012.01)
(Continued)

(52) U.S. Cl.
CPC ..... *E21B 33/13* (2013.01); *E21B 17/1078* (2013.01); *E21B 27/02* (2013.01);
(Continued)

(58) Field of Classification Search
CPC ..... E21B 33/13; E21B 47/017; E21B 47/18; E21B 47/26; E21B 17/1078; E21B 27/00; E21B 27/02
See application file for complete search history.

(56) References Cited

U.S. PATENT DOCUMENTS 1,889,865 A * 12/1932 Miller ..... E21B 27/00 166/167
4,464,993 A * 8/1984 Porter ..... F42D 1/20 102/312

(Continued)

FOREIGN PATENT DOCUMENTS

CN 105971555 A * 9/2016
EP 1653042 A1 5/2006

(Continued)

OTHER PUBLICATIONS

International Search Report and Written Opinion of PCT Application No. PCT/US2021/027239 (SA51287) dated Jun. 29, 2021: pp. 1-11.

*Primary Examiner* — Jennifer H Gay
(74) *Attorney, Agent, or Firm* — Bracewell LLP; Constance G. Rhebergen; Linda L. Morgan

(57) ABSTRACT

Systems and methods for managing a loss circulation zone in a subterranean well include a tool housing located on a surface of a tubular member with a tool cavity that is an interior open space within the tool housing. An electromechanical system is located within the tool cavity and has a printed circuit board, a microprocessor, a sensor system, a power source, and a communication port assembly. A release system can move a deployment door of a deployment opening of the tool housing between a closed position and an open position. The deployment opening can provide a flow path between the tool cavity and an outside of the tool housing. The release system is actuable autonomously by the electromechanical system. A releasable product is located within the tool cavity and can travel through the deployment opening when the deployment door is in the open position.

23 Claims, 11 Drawing Sheets

(51) Int. Cl.

| | |
|---|---|
| ***E21B 47/26*** | (2012.01) |
| ***E21B 17/10*** | (2006.01) |
| ***E21B 27/02*** | (2006.01) |
| ***E21B 47/18*** | (2012.01) |

(52) U.S. Cl.
CPC ..... *E21B 47/017* (2020.05); *E21B 47/18* (2013.01); *E21B 47/26* (2020.05)

(56) References Cited

U.S. PATENT DOCUMENTS

| | | | | |
|---|---|---|---|---|
| 7,287,591 | B2 * | 10/2007 | Campbell | E21B 27/02 166/162 |
| 7,432,499 | B2 | 10/2008 | Edwards et al. | |
| 8,005,618 | B2 | 8/2011 | Gzara | |
| 8,297,353 | B2 * | 10/2012 | Roddy | E21B 47/10 166/250.14 |
| 8,561,696 | B2 * | 10/2013 | Trummer | E21B 47/09 166/255.1 |
| 8,899,349 | B2 | 12/2014 | Rasmus et al. | |
| 8,935,957 | B2 | 1/2015 | Kulkarni et al. | |
| 9,401,795 | B2 | 7/2016 | Chae et al. | |
| 9,745,820 | B2 * | 8/2017 | Watson | E21B 43/114 |
| 9,784,061 | B2 * | 10/2017 | Al-Fahad | E21B 34/14 |
| 9,790,755 | B2 * | 10/2017 | Bourque | E21B 27/02 |
| 9,896,913 | B2 * | 2/2018 | Nyhavn | E21B 27/00 |
| 9,896,926 | B2 | 2/2018 | Steele | |
| 10,047,604 | B2 | 8/2018 | Graves et al. | |
| 10,053,978 | B2 | 8/2018 | Hay et al. | |
| 10,062,044 | B2 | 8/2018 | Hildebrand et al. | |
| 10,078,154 | B2 | 9/2018 | Logan et al. | |
| 10,119,392 | B2 | 11/2018 | Yerubandi et al. | |
| 11,125,046 | B2 * | 9/2021 | Li | E21B 21/003 |
| 2006/0102336 | A1 * | 5/2006 | Campbell | E21B 27/02 166/65.1 |
| 2009/0294174 | A1 | 12/2009 | Harmer et al. | |
| 2010/0122813 | A1 * | 5/2010 | Trummer | E21B 33/138 166/255.1 |
| 2011/0192598 | A1 * | 8/2011 | Roddy | E21B 47/005 166/253.1 |
| 2011/0220350 | A1 | 9/2011 | Daccord et al. | |
| 2013/0087333 | A1 * | 4/2013 | Seth | C04B 28/02 166/288 |
| 2014/0231068 | A1 * | 8/2014 | Isaksen | E21B 23/06 166/123 |
| 2014/0318782 | A1 * | 10/2014 | Bourque | E21B 27/02 166/286 |
| 2016/0201454 | A1 * | 7/2016 | Nyhavn | E21B 47/06 73/152.51 |
| 2016/0348454 | A1 * | 12/2016 | Al-Fahad | E21B 27/02 |
| 2016/0348467 | A1 * | 12/2016 | Watson | E21B 27/02 |
| 2017/0321104 | A1 * | 11/2017 | Ravi | E21B 33/16 |
| 2018/0274312 | A1 | 9/2018 | Zhou | |
| 2019/0010803 | A1 | 1/2019 | Purkis | |
| 2019/0368292 | A1 * | 12/2019 | Al-Mousa | E21B 33/13 |
| 2020/0011156 | A1 * | 1/2020 | Hajji | E21B 31/03 |
| 2020/0088002 | A1 * | 3/2020 | AlShuraim | E21B 33/127 |
| 2021/0054716 | A1 * | 2/2021 | Al-Mousa | E21B 21/003 |
| 2021/0164329 | A1 * | 6/2021 | Affleck | E21B 21/003 |
| 2021/0172269 | A1 * | 6/2021 | Li | E21B 21/003 |
| 2021/0172270 | A1 * | 6/2021 | Li | E21B 33/13 |
| 2021/0172281 | A1 * | 6/2021 | Li | E21B 21/003 |
| 2021/0324702 | A1 * | 10/2021 | Li | E21B 23/00 |

FOREIGN PATENT DOCUMENTS

| | | | | |
|---|---|---|---|---|
| WO | WO-2016089378 | A1 * | 6/2016 | C04B 28/18 |
| WO | WO-2016163996 | A1 * | 10/2016 | C09K 8/428 |
| WO | WO-2019027830 | A1 * | 2/2019 | E21B 43/103 |
| WO | 2019231332 | A2 | 12/2019 | |

* cited by examiner

METHOD AND APPARATUS FOR IDENTIFYING AND REMEDIATING LOSS CIRCULATION ZONE

BACKGROUND

1. Field of the Disclosure

The present disclosure relates in general to the development of subterranean wells, and more particularly to a tool for measuring properties of a loss circulation zone and automatically releasing a stored product based on such measured properties.

2. Description of the Related Art

During the drilling of subterranean wells, such as subterranean wells used in hydrocarbon development operations, drilling mud and other fluids can be pumped into the well. In certain drilling operations, the bore of the subterranean well can pass through a zone that has induced or natural fractures, are cavernous, or otherwise have a high permeability, and which is known as a loss circulation zone. In addition, wellbore stability issues can occur while drilling in any well and can include hole collapse, or fractures leading to a lost circulation. These issues can be due to weak formations, permeable rocks, or fractures that occurs naturally or are induced while drilling.

When a loss circulation zone is present, drilling mud and other fluids that are pumped into the well can flow into the loss circulation zone. In such cases all, or a portion of the drilling mud and other fluids can be lost in the loss circulation zone. Lost circulation can be identified when drilling fluid that is pumped into the subterranean well returns partially or does not return at all to the surface. While some fluid loss is expected, excessive fluid loss is not desirable from a safety, an economical, or an environmental point of view.

Lost circulation can result in difficulties with well control, borehole instability, pipe sticking, unsuccessful production tests, poor hydrocarbon production after well completion, and formation damage due to plugging of pores and pore throats by mud particles. In extreme cases, lost circulation problems may force abandonment of a well. Sealing these problematic zones is important before continuing to drill the rest of the well. If the problem zone is not sealed or supported, the wellbore wall can collapse and cause the drill string to get stuck, or the drilling mud can become lost in the formation.

SUMMARY OF THE DISCLOSURE

Current method of identifying loss zone is by spotting the fluid loss while drilling into certain formations. The level of understanding of the loss circulation zone in some current systems is limited to global sensing of drilling fluid volume change.

Instead of having vague understanding of lost zone by counting the global fluid volume change, embodiments of this disclosure provide distributed sensors are installed along the drill pipe to monitor the number of downhole parameters to identify the loss zones and their locations and characteristics. Systems and methods of this disclosure provide for distributed devices that are attached on the external surface of a drill pipe and integrated with blade-shaped stabilizers to autonomously identify loss circulation zones thorough sensor fusion and a sensing strategy, followed by autonomous deployment mechanisms to remediate loss zone and communicate to the surface.

By following a sensing strategy, a number of on-board sensors are activated in a specific sequence to measure the change of downhole conditions such as temperature, pressure, and flow rate, which narrows down the location and severity of the loss circulation zones. The system includes advanced algorithms incorporated with sensors for identifying and locating loss circulation zones autonomously. The device is integrated with a deployment mechanism that takes actions based on the confirmation of the loss zone.

In an embodiment of this disclosure, a system for managing a loss circulation zone in a subterranean well includes a tool housing located on a surface of a tubular member. The tool housing has a tool cavity. The tool cavity is an interior open space within the tool housing. An electromechanical system is located within the tool cavity. The electromechanical system has a printed circuit board, a microprocessor, a sensor system, a power source, and a communication port assembly. A release system is operable to move a deployment door of a deployment opening of the tool housing between a closed position and an open position. The deployment opening provides a flow path between the tool cavity and an outside of the tool housing when the deployment door is in the open position. The release system is actuable autonomously by the electromechanical system. A releasable product is located within the tool cavity. The releasable product is operable to travel through the deployment opening when the deployment door is in the open position.

In alternate embodiments, the deployment opening can extend between the tool cavity and the outside of the tool housing radially exterior of the tubular member. The deployment opening can alternately extend between the tool cavity and the outside of the tool housing within a central bore of the tubular member. The tubular member cab include a reader sub located downhole of the tool housing. The tool housing can be fixed to an outer diameter surface of the tubular member. The tool housing can be a drill string stabilizer. The tool housing can alternately be located within an outer cavity that is secured to an outer diameter surface of the tubular member.

In other alternate embodiments, the releasable product can be a lost circulation fabric located within the tool cavity. The lost circulation fabric can be releasable out of the tool cavity when the deployment door is in the open position. Alternately, the releasable product can be a plurality of microchip balls located within the tool cavity. The plurality of microchip balls can be releasable out of the tool cavity when the deployment door is in the open position. The plurality of microchip balls can include a computational module, a memory, a sensor, a battery, and a download data port operable for data download. Alternately, the plurality of microchip balls can include a computational module, a memory, a download data port operable for data download, and a downhole data port operable for downhole data transfer.

In yet other alternate embodiments, the communication port assembly can include at least one of a charging port operable for charging of the power source, and a data port for transferring data between the electromechanical system and an external device. The tubular member can be a joint of a tubular string and the system can include more than one tool housing spaced along a length of the tubular string.

In an alternate embodiment of this disclosure, a method for managing a loss circulation zone in a subterranean well includes locating a tool housing on a surface of a tubular member, the tool housing having a tool cavity. The tool cavity is an interior open space within the tool housing. An electromechanical system is located within the tool cavity, the electromechanical system having a printed circuit board, a microprocessor, a sensor system, a power source, and a communication port assembly. A release system is operable to move a deployment door of a deployment opening of the tool housing between a closed position and an open position. The deployment opening provides a flow path between the tool cavity and an outside of the tool housing when the deployment door is in the open position. The release system is actuable autonomously by the electromechanical system. A releasable product is positioned within the tool cavity. The releasable product is operable to travel through the deployment opening when the deployment door is in the open position.

In alternate embodiments, the method can include releasing the releasable product through the deployment opening. The deployment opening can extend between the tool cavity and the outside of the tool housing radially exterior of the tubular member. Alternately, the deployment opening can extend between the tool cavity and the outside of the tool housing within a central bore of the tubular member. The tubular member can include a reader sub located downhole of the tool housing and the method can further include flowing the releasable product through an inner diameter of the reader sub and downloading data from the releasable product with the reader sub. The data downloaded can be transferred by the reader sub to the surface through mud pulse telemetry.

In other alternate embodiments, the tool housing can be fixed to an outer diameter surface of the tubular member and the method can further include stabilizing the tubular member with the tool housing. The releasable product can be a lost circulation fabric located within the tool cavity and the method can further include releasing the lost circulation fabric out of the tool cavity when the deployment door is in the open position and positioning the lost circulation fabric across an inner diameter surface of a wellbore of the subterranean well at the loss circulation zone. Alternately, the releasable product can be a plurality of microchip balls located within the tool cavity and the method can further include collecting downhole data with the plurality of microchip balls, releasing the plurality of microchip balls out of the tool cavity when the deployment door is in the open position, and delivering the downhole data collected by the plurality of microchip balls to the surface. Wellbore information can be measured with the plurality of microchip balls as the plurality pf microchip balls travel from the tool cavity to the surface In still other alternate embodiments, the communication port assembly can include a port operable for charging of the power source, and the method can further include charging the power source before delivering the tool housing into the subterranean well. The communication port assembly can include a port for transferring data between the electromechanical system and an external device, and the method can further include initiating and configuring the electromechanical system before delivering the tool housing into the subterranean well.

BRIEF DESCRIPTION OF THE DRAWINGS

So that the manner in which the above-recited features, aspects and advantages of the disclosure, as well as others that will become apparent, are attained and can be understood in detail, a more particular description of the embodiments of the disclosure briefly summarized above may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The Specification, which includes the Summary of Disclosure, Brief Description of the Drawings and the Detailed Description, and the appended Claims refer to particular features (including process or method steps) of the disclosure. Those of skill in the art understand that the disclosure includes all possible combinations and uses of particular features described in the Specification. Those of skill in the art understand that the disclosure is not limited to or by the description of embodiments given in the Specification. The inventive subject matter is not restricted except only in the spirit of the Specification and appended Claims.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this disclosure relates unless defined otherwise.

As used in the Specification and appended Claims, the singular forms "a", "an", and "the" include plural references unless the context clearly indicates otherwise. As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Spatial terms describe the relative position of an object or a group of objects relative to another object or group of objects. The spatial relationships apply along vertical and horizontal axes. Orientation and relational words including "uphole" and "downhole"; "above" and "below" and other like terms are for descriptive convenience and are not limiting unless otherwise indicated.

Where the Specification or the appended Claims provide a range of values, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the Specification and appended Claims to a method comprising two or more defined steps, the defined steps can be carried out in any order or simultaneously except where the context excludes that possibility.

Figure 1:
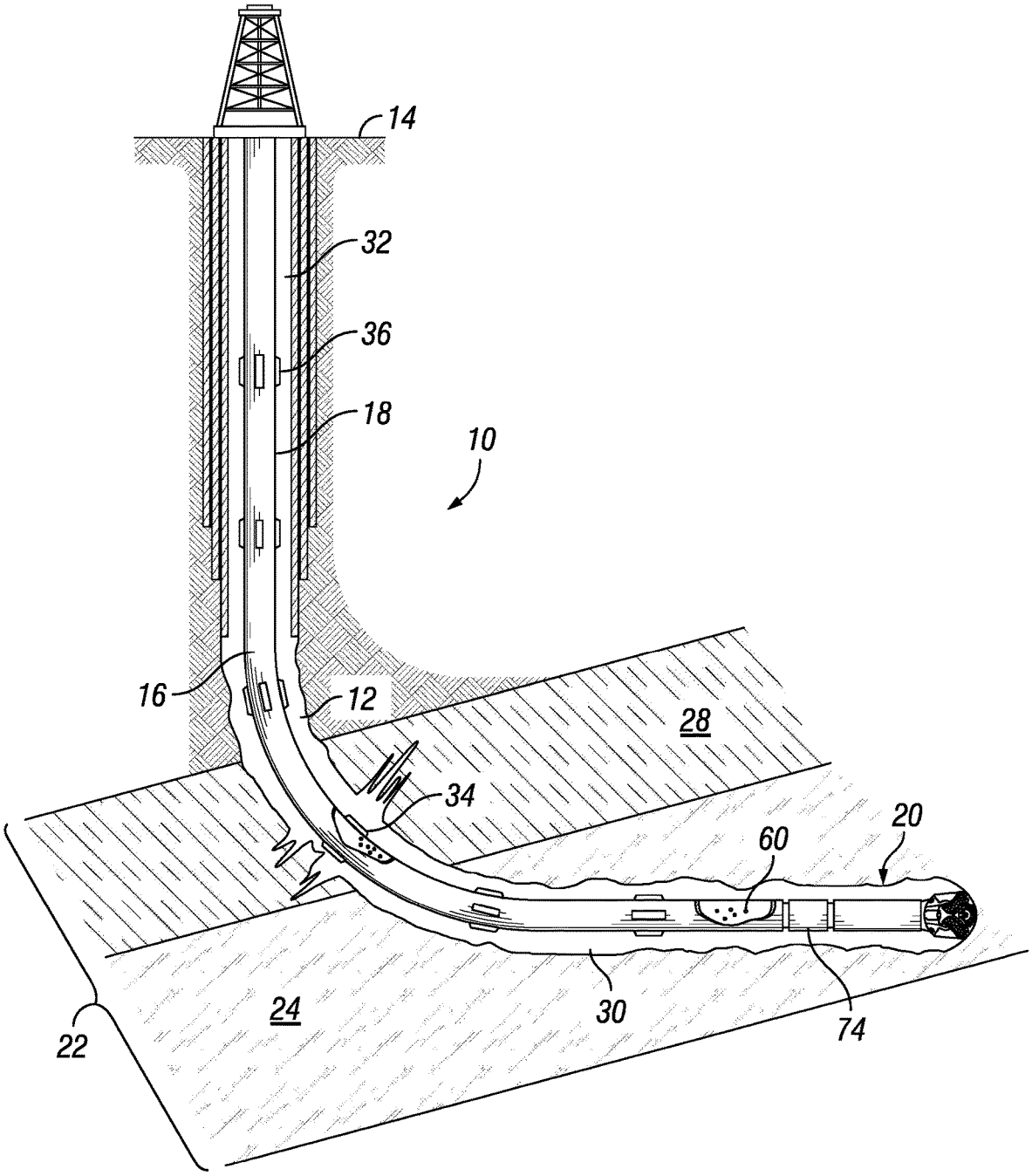
FIG. 1 is a schematic section view of a subterranean well with a loss circulation zone and a system for managing a loss circulation zone, in accordance with an embodiment of this disclosure.

Looking at FIG. 1, subterranean well 10 can have wellbore 12 that extends to an earth's surface 14. Subterranean well 10 can be an offshore well or a land based well and can be used for producing hydrocarbons from subterranean hydrocarbon reservoirs. A tubular string, such as drill string 16, can be delivered into and located within wellbore 12. Drill string 16 can include tubular member 18 and bottom hole assembly 20. Tubular member 18 can extend from earth's surface 14 into subterranean well 10. Bottom hole assembly 20 can include, for example, drill collars, stabilizers, reamers, shocks, a bit sub and the drill bit. Drill string 16 can be used to drill wellbore 12. In certain embodiments, tubular member 18 is rotated to rotate the bit to drill wellbore 12.

Wellbore 12 can be drilled from surface 14 and into and through various formation zones 22. Formation zones 22 can include layers of reservoir that are production zones, such as production zone 24. Formation zones 22 can also include an unstable or loss circulation zone, such as a problem zone that is loss circulation zone 28. In the example embodiment of FIGS. 1, loss circulation zone 28 is a layer of the formation zones 22 that is located between uphole of production zone 24. In alternate embodiments, loss circulation zone 28 can be downhole of production zone 24 or located between production zones.

The formation zone 22 can be at an elevation of uncased open hole bore 30 of subterranean well 10. Drill string 16 can pass though cased bore 32 of subterranean well 10 in order to reach uncased open hole bore 30. Alternately, the entire wellbore 12 can be an uncased open hole bore.

In order to further understand and to alternately treat loss circulation zone 28, one or more loss circulation tools 34 can be included in drill string 16. Loss circulation tool 34 can be used to manage loss circulation zone 28 in subterranean well 10, as discussed in this disclosure. In the example embodiment of FIG. 1, tubular member 18 is a joint of a tubular string that is drill string 16, and the system includes more than one tool housing 36 of separate loss circulation tools 34 that are spaced along a length of the tubular string, as well as spaced circumferentially around an outer diameter of the tubular string.

Figure 2:
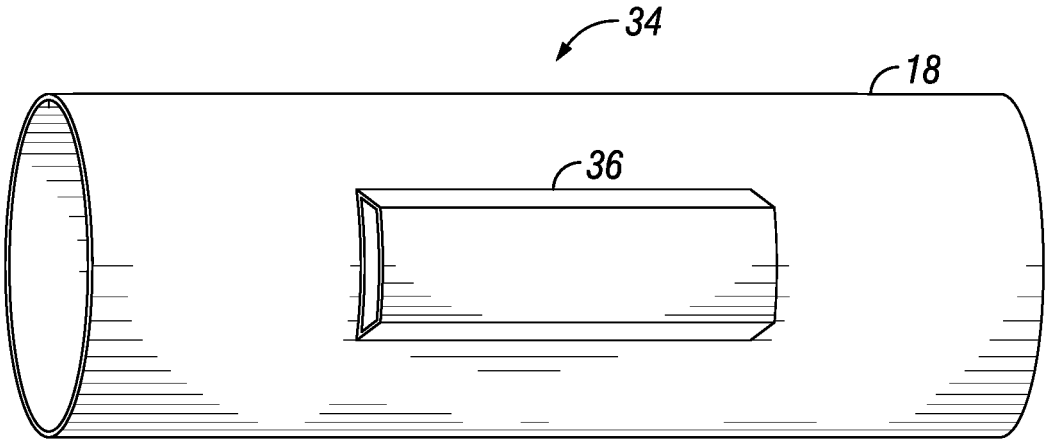
FIG. 2 is a perspective view of a loss circulation tool included in drill string, in accordance with an embodiment of this disclosure.
Figure 3:
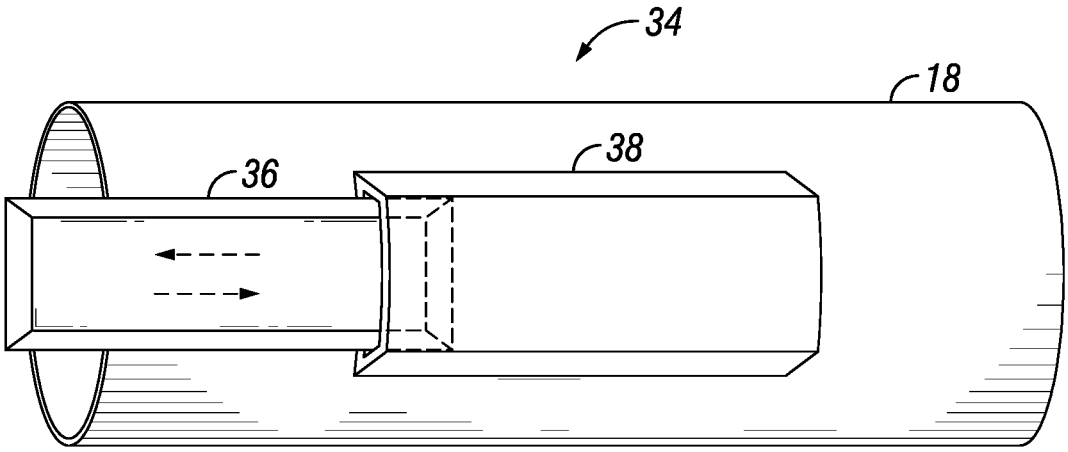
FIG. 3 is a perspective view of a loss circulation tool included in drill string, in accordance with an alternate embodiment of this disclosure.

Looking at FIGS. 2-3, loss circulation tool 34 includes tool housing 36 that is located on a surface of tubular member 18. In the example embodiment of FIG. 2, tool housing 36 is fixed directly to an outer diameter surface of tubular member 18. Tool housing 36 can be formed of a non-metallic composite such as, for example, a carbon fiber ceramic material. In such an embodiment, tool housing 36 is a fabricated to be a permanent part of tubular member 18. In alternate embodiments, tool housing 36 can be integrally formed as part of a tool sub.

In the example embodiment of FIG. 3, tool housing 36 is located within outer cavity 38 that is secured directly to the outer diameter surface of tubular member 18. Tool housing 36 and outer cavity 38 can be formed of a non-metallic composite such as, for example, a carbon fiber ceramic material. In such an embodiment, outer cavity 38 is a fabricated to be a permanent part of tubular member 18. Tool housing 36 can be a swappable module that can be installed into, and removed from, outer cavity 38. In alternate embodiments, outer cavity 38 can be integrally formed as part of a tool sub.

Tool housing 36 and outer cavity 38, as applicable, can be formed to function as a drill string stabilizer blade. The stabilizer blade length, angle and spacing can be designed to fit a specific well application. In particular, the size, spacing, and orientation of loss circulation tool 34 is especially critical for a close tolerance tubing annulus. The non-metallic composite tool housing 36 and outer cavity 38, as applicable, can also reduce the friction in extended reach laterals to prevent buckling of the tubing members. Loss circulation tool 34 can therefore not only perform lost circulation mitigation tasks, but can also serve as a stabilizer for general drilling optimization.

Figure 4:
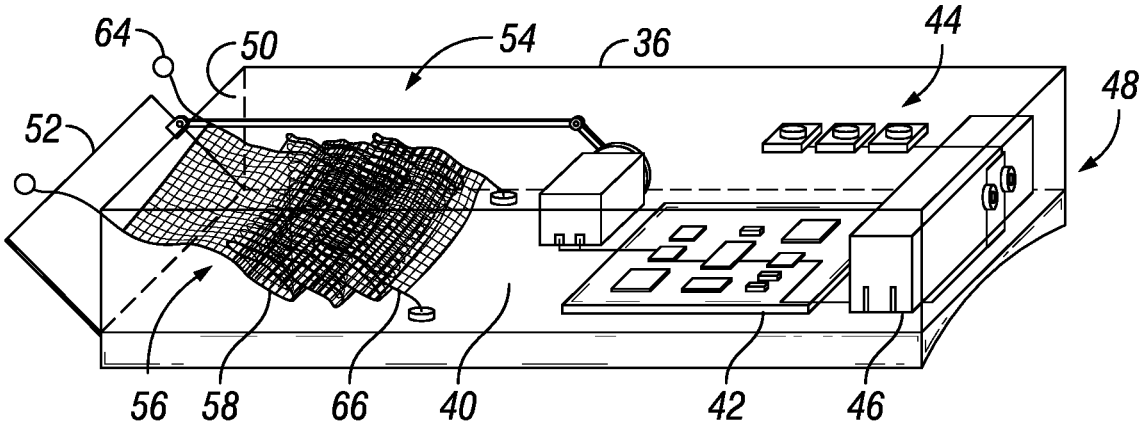
FIG. 4 is a perspective view of a tool housing, in accordance with an embodiment of this disclosure, shown with lost circulation fabric located with the tool cavity.
Figure 5:
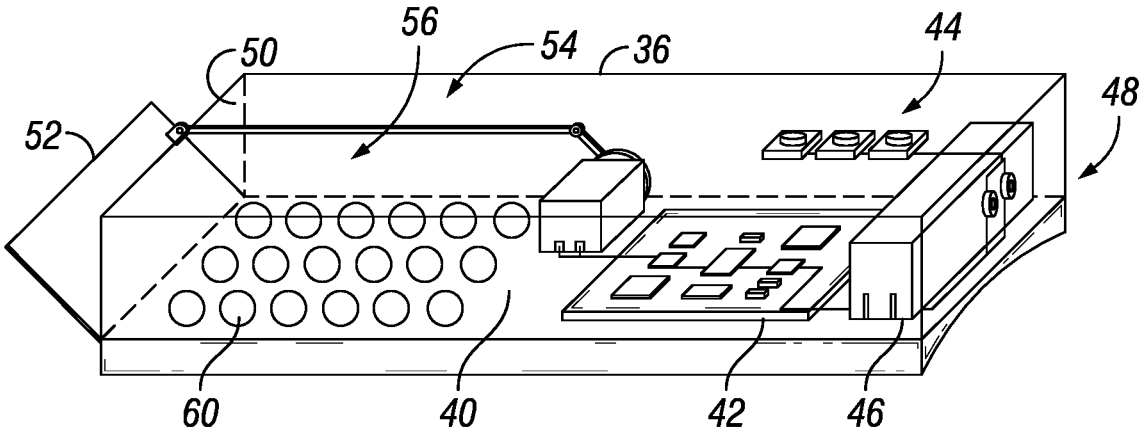
FIG. 5 is a perspective view of a tool housing, in accordance with an embodiment of this disclosure, shown with microchip balls located with the tool cavity.

Looking at FIGS. 4-5, tool housing 36 has tool cavity 40. Tool cavity 40 is an interior open space within tool housing 36. Tool cavity 40 can house the components required for the operation of loss circulation tool 34. As an example, tool cavity 40 can house an electromechanical system that includes printed circuit board 42 with a microprocessor, sensor system 44, power source 46, and communication port assembly 48.

Figure 19:
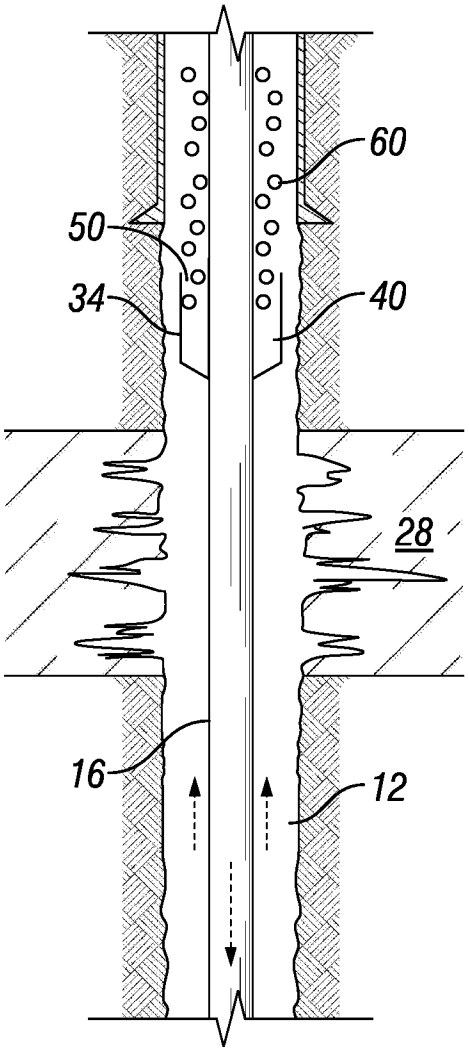
FIG. 19 is a schematic detail section view of a subterranean well with a loss circulation tool, in accordance with an embodiment of this disclosure, shown with microchip balls being released from the loss circulation tool and into the tubing annulus.
Figure 21:
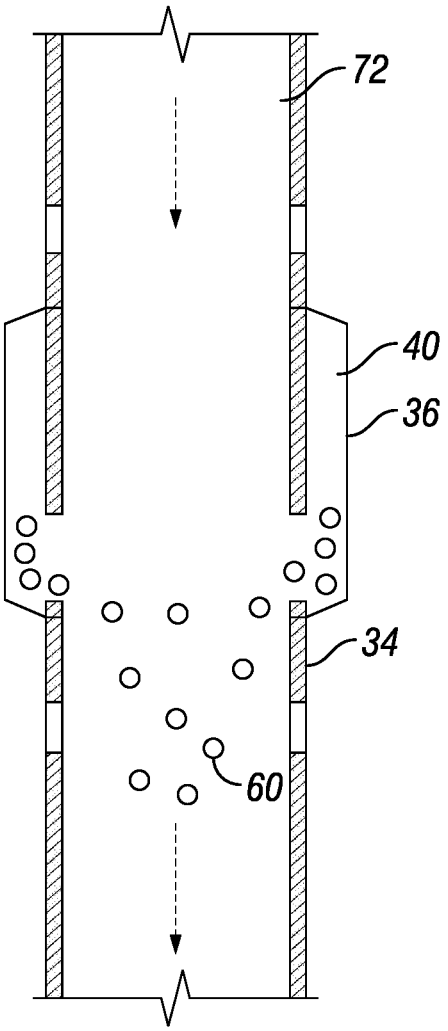
FIG. 21 is a schematic detail section view of a tubular member with a loss circulation tool, in accordance with an embodiment of this disclosure, shown with microchip balls being released from the loss circulation tool and into the central bore of the tubular member.

Deployment opening 50 provides a flow path between tool cavity 40 and an outside of tool housing 36 when a deployment door 52 is in the open position, as shown in FIGS. 4-5. Deployment opening 50 can extend between tool cavity 40 and the outside of tool housing 36 radially exterior of tubular member 18 (FIG. 19). In alternate embodiments, deployment opening 50 extends between tool cavity 40 and the outside of tool housing 36 within a central bore of tubular member 18 (FIG. 21).

Release system 54 can be used to move deployment door 52 between a closed position and an open position. Release system 54 is actuable autonomously by the electromechanical system. As an example, the electromechanical system can be programed with advanced algorithms that are used in conjunction with sensor system 44 for identifying and locating loss circulation zones 28 autonomously. Release system 54 can be actuated automatically without communication from the surface, based on the data collected by sensor system 44 or by positive identification of loss circulation zone 28 by sensor system 44, or a combination of both.

Communication port assembly 48 can include a port for transferring data between the electromechanical system and an external device. As an example, a data port of communication port assembly 48 can be used for initiating and configuring the electromechanical system before delivering tool housing 36 into subterranean well 10. Communication port assembly 48 can also include a charging port that is operable for charging power source 46 before delivering tool housing 36 into subterranean well 10.

Tool cavity 40 can further include releasable product 56. Releasable product 56 can travel through deployment opening 50 when deployment door 52 is in the open position of FIGS. 4-5. In the example embodiment of FIG. 4, releasable product 56 is lost circulation fabric 58. Lost circulation fabric 58 is releasable out of tool cavity 40 when deployment door 52 is in the open position. In the example embodiment of FIG. 5, releasable product 56 is a plurality of microchip balls 60 that are located within tool cavity 40, the plurality of microchip balls 60 being releasable out of tool cavity 40 when deployment door 52 is in the open position.

Figure 6:
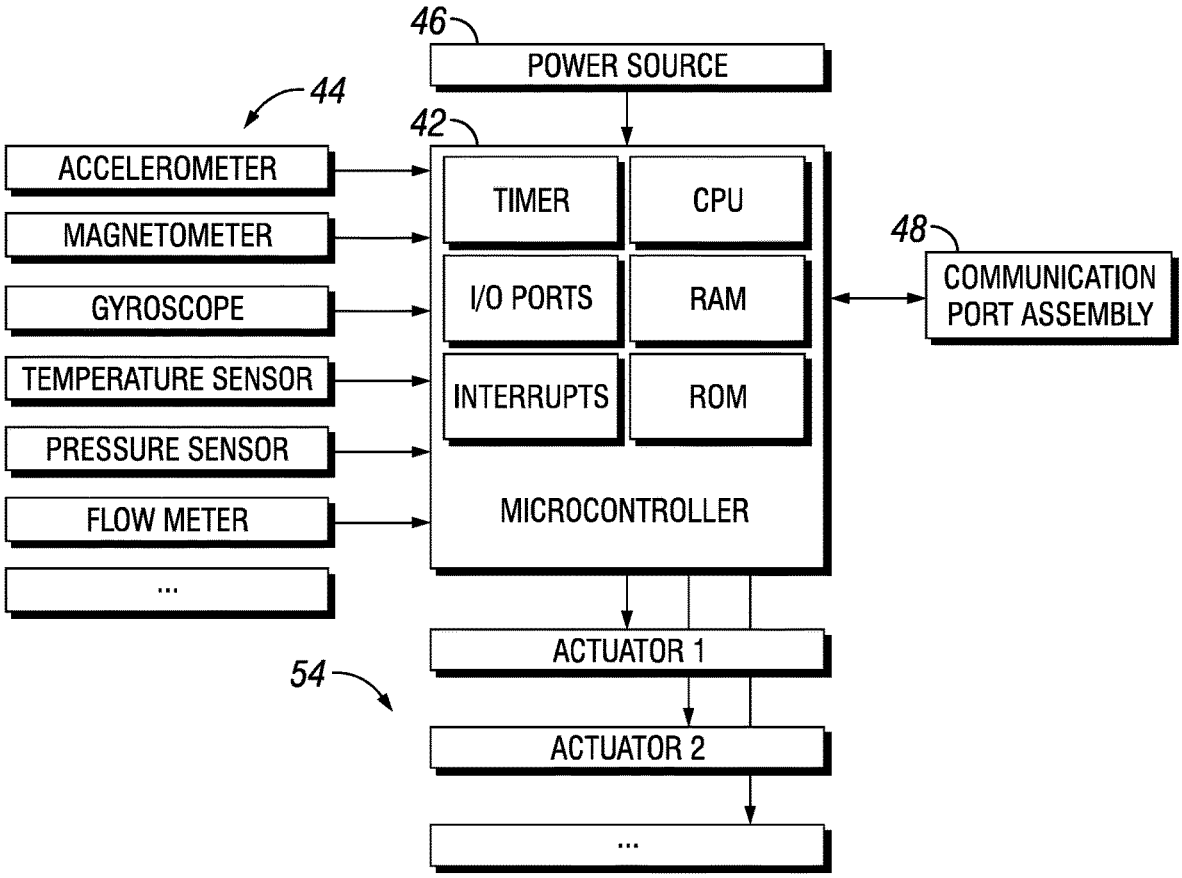
FIG. 6 is a schematic diagram of the electromechanical system that is located within the tool cavity, in accordance with an embodiment of this disclosure.

Looking at FIG. 6, the interaction between the components of the electromechanical system of loss circulation tool 34 is shown. Printed circuit board 42 can be powered by power source 46. Printed circuit board 42 can include a microcontroller that has a timer, input/output ports, and interrupt logic. Each of the timer, input/output ports, and interrupt logic can be in communication with sensor system 44. The microcontroller can further include a central processing unit (CPU) for executing instructions, random access memory (RAM) for short-term data storage, and Read-Only Memory (ROM) for storing permanent or semi-permanent data.

Sensor system 44 can include a variety of sensors. The sensors can include an accelerometer, a magnetometer, a gyroscope, a temperature sensor, a pressure sensor, a flow meter, other known downhole sensors, and combinations of such sensors. The sensors are fused into a sensing strategy to identify the proximity of loss circulation zone 28 to loss circulation tool 34, to confirm the depth of loss circulation zone 28 within subterranean well 10, and to determine the severity and other characteristics of loss circulation zone 28. Due to the fused sensing strategy, the data can be collected with minimum power consumption. As an example, by following a sensing strategy, a number of the sensors are activated in a specific sequence to acquire the downhole data.

Printed circuit board 42 can be pre-programmed with advanced algorithms that are incorporated with the sensors for identifying and locating loss circulation zone 28 autonomously. Communication port assembly 48 can be used for pre-programming printed circuit board 42 before loss circulation tool 34 is delivered into subterranean well 10.

Printed circuit board 42 can further be in communication with release system 54. Release system 54 can be actuated autonomously by printed circuit board 42 based on data gathered by the sensors of sensor system 44. As an example, release system 54 can be actuated after confirmation of the location and severity of loss circulation zone 28. When loss circulation zone 28 is identified, the microcontroller can send commends to actuators of release system 54 to release the releasable product 56 from tool cavity 40 (FIGS. 4-5). Releasable product 56 can be, for example lost circulation fabric 58 (FIG. 4) or microchip balls 60 (FIG. 5).

Looking at FIG. 4, lost circulation fabric 58 can be folded inside tool cavity 40. Lost circulation fabric 58 is a membrane or net-like composite material that is soft, yet tough and abrasion resistant. Lost circulation fabric 58 can be deployed in wellbore 12 to extend across and repair loss circulation zone 28.

Figure 7:
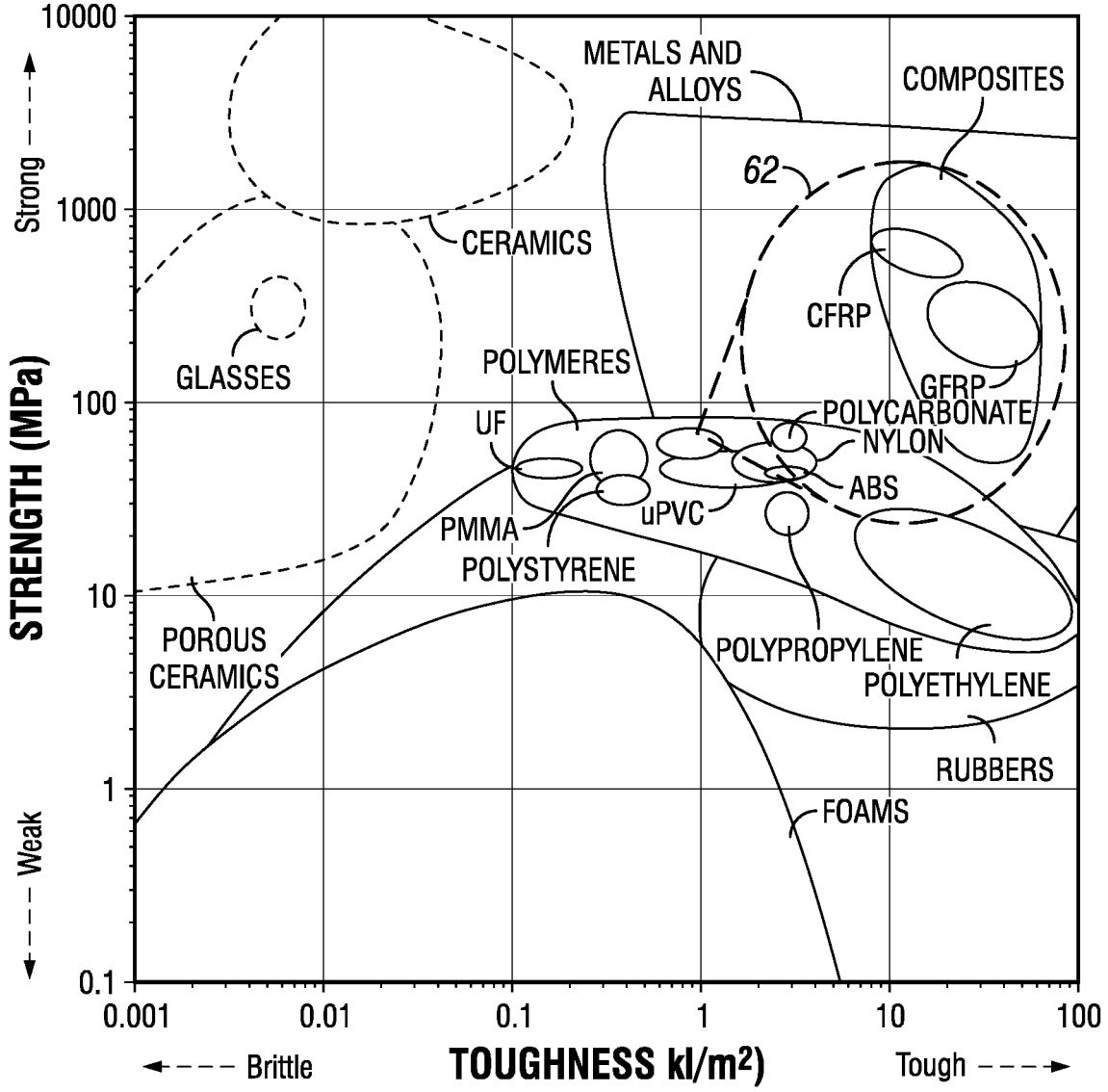
FIG. 7 is a chart providing strength and toughness information for materials that can be used to form loss circulation fabric, in accordance with an embodiment of this disclosure.

Looking at FIG. 7, ideal materials for manufacturing lost circulation fabric 58 are indicated as those within the boundary of the circle with reference number 62. Materials that can be used to form lost circulation fabric 58 include soft materials with high tensile strength, high toughness and good thermal stability. As an example, and with reference to FIG. 7, the materials that can be used to form lost circulation fabric 58 can have a strength in a range of 20 to 2,000 MPa, and a toughness in a range of 2 to 80 kJ/m2.

Polymers such as certain nylon, polycarbonate, and high temperature polyethylene are the potential candidates for forming the net of lost circulation fabric 58. Other common uses for such material is for making fish line and fish net.

Other materials that can be used to form lost circulation fabric 58 include composites. Composites can have improved engineering properties compared to polymers. Materials such as carbon fiber reinforced polymer (CFRP) and glass fiber reinforced polymer (GFRP) can be used for forming lost circulation fabric 58.

Looking at FIG. 4, floats 64 are connected to net 66 of lost circulation fabric 58. Floats 64 can be formed of a low density material. As an example, the density of floats 64 can result in floats 64 having positive buoyancy in the drilling fluid. As lost circulation fabric 58 is deployed, drilling fluid can carry floats 64 in the direction of the flow of the drilling fluid. Movement of floats 64 in the drilling fluid pull folded lost circulation fabric 58 out of tool cavity 40.

Figure 9:
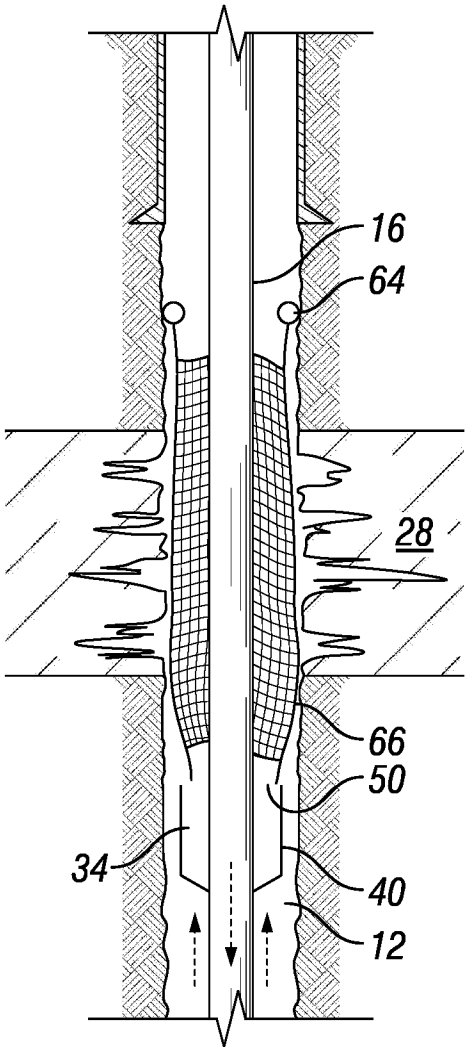
FIG. 9 is a schematic detail section view of a subterranean well with a loss circulation tool, in accordance with an embodiment of this disclosure, shown with a loss circulation fabric being released from the tool cavity of the tool housing.
Figure 8:
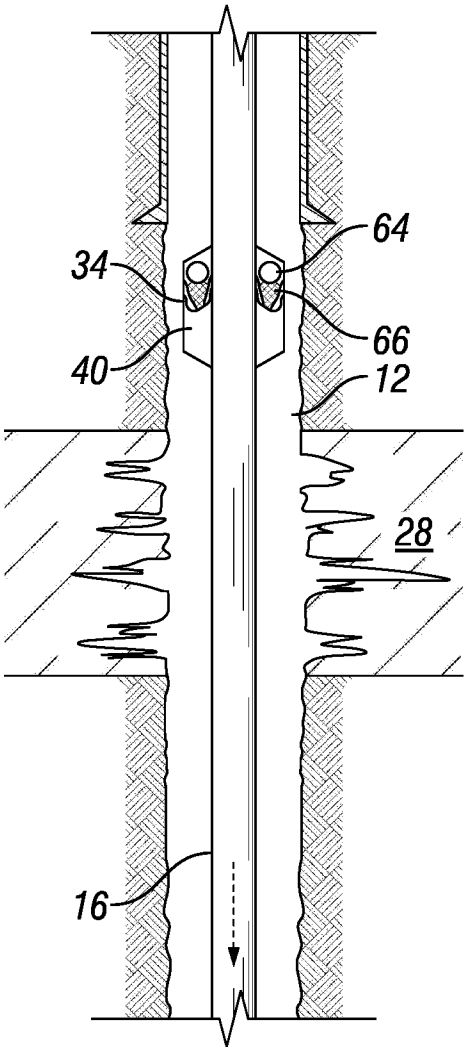
FIG. 8 is a schematic detail section view of a subterranean well with a loss circulation tool, in accordance with an embodiment of this disclosure, shown with a loss circulation fabric folded in the tool cavity of the tool housing.
Figure 11:
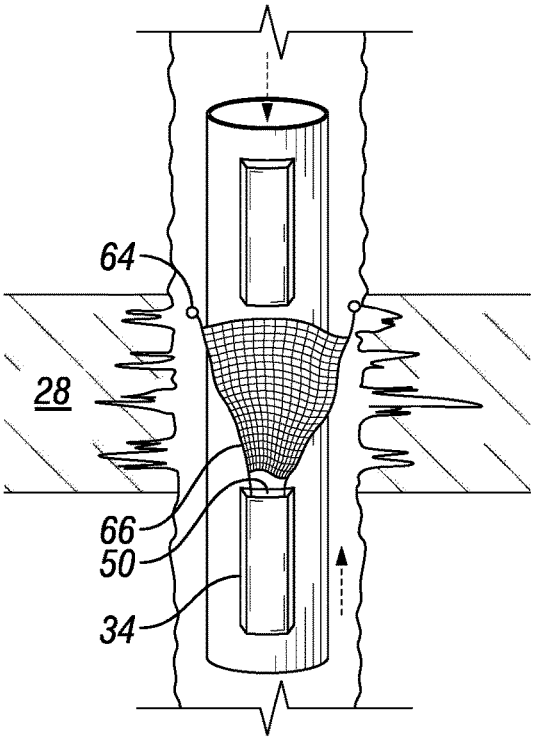
FIG. 11 is a schematic detail partial section view of a subterranean well with a loss circulation tool, in accordance with an embodiment of this disclosure, shown with a loss circulation fabric being released from the tool cavity of the tool housing.
Figure 12:
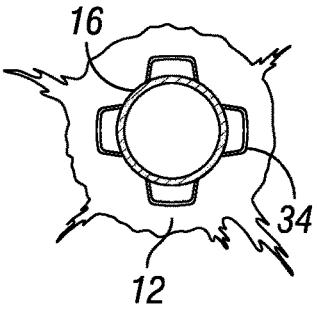
FIG. 12 is a schematic cross section view of a subterranean well with a loss circulation tool, in accordance with an embodiment of this disclosure.
Figure 13:
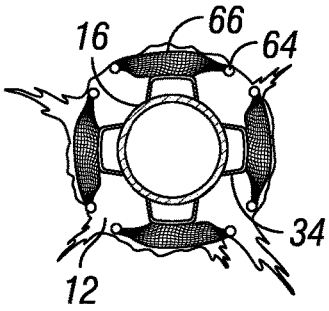
FIG. 13 is a schematic cross section view of a subterranean well with a loss circulation tool, in accordance with an embodiment of this disclosure, shown with a loss circulation fabric being released from the tool cavity of the tool housing.

Looking at FIGS. 8 and 12, drill string 16 can be delivered into wellbore 12. Lost circulation fabric 58 can be folded within tool cavity 40 of loss circulation tool 34. Looking at FIGS. 9, 11, and 13, when it is determined, through data collected by sensor system 44 (FIG. 4) that loss circulation tool 34 has moved downhole of loss circulation zone 28, then drill string 16 can stop moving axially within wellbore 12. Printed circuit board 42 can actuate release system 54 to move deployment door 52 to the open position (FIG. 4).

Figure 10:
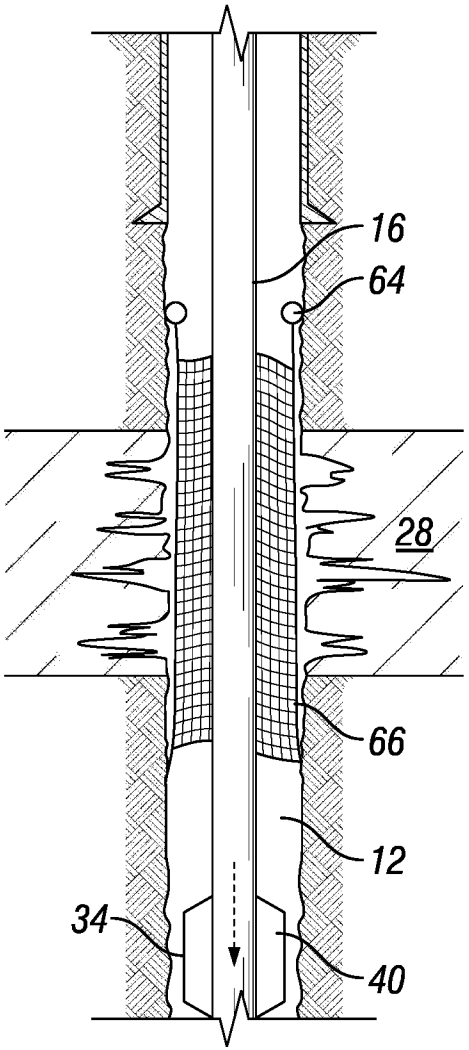
FIG. 10 is a schematic detail section view of a subterranean well with a loss circulation tool, in accordance with an embodiment of this disclosure, shown with a loss circulation fabric located across a loss circulation zone.
Figure 14:
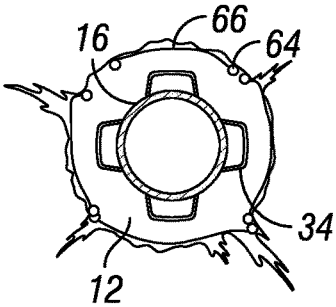
FIG. 14 is a schematic cross section view of a subterranean well with a loss circulation tool, in accordance with an embodiment of this disclosure, shown with a loss circulation fabric located across a loss circulation zone.

With deployment door 52 in an open position, lost circulation fabric 58 will exit deployment opening 50 and enter the annulus radially exterior of drill string 16. Floats 64 will be moved with the flow of drilling fluid through the annulus and pull lost circulation fabric 58 out of tool cavity 40. Floats 64 can unfold and spread lost circulation fabric 58 towards loss circulation zone 28. Looking at FIGS. 10 and 14, a pre-defined time delay before moving drill string 16 axially within wellbore 12 will allow loss circulation fabric 58 to fully spread out and cover the internal surface of wellbore 12 at loss circulation zone 28, mitigating lost circulation into loss circulation zone 28. After the time delay, loss circulation fabric 58 is separated from loss circulation tool 34, for example, by moving drill string 16 radially downhole. If needed, a loss circulation material can additional be delivered to loss circulation zone 28 to seal loss circulation zone 28.

Looking at FIG. 5, releasable product 56 can be microchip balls 60. Microchip balls 60 can store the information that is gathered by the sensors of sensor system 44. Microchip balls 60 can be spherical members that are sized so that a plurality of microchip balls can be located within tool cavity 40. As an example, microchip balls 60 can have an outer diameter of less than ten millimeters.

Figure 15:
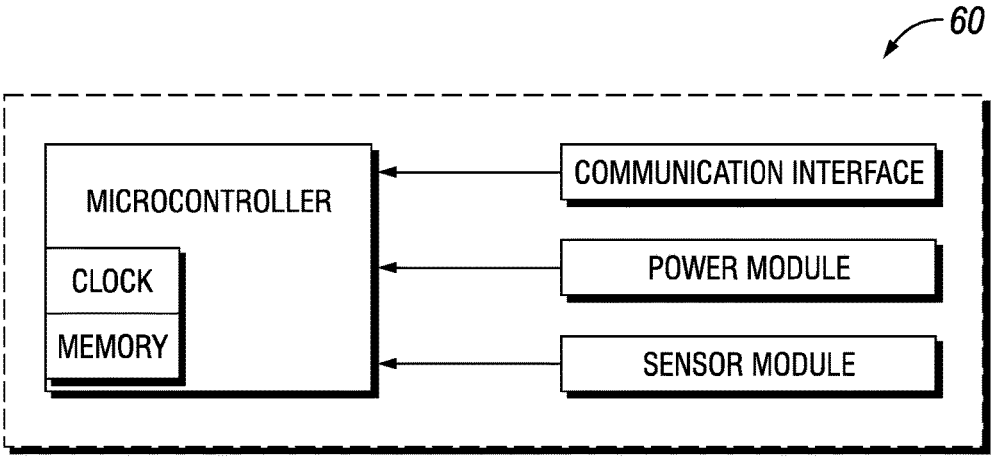
FIG. 15 is a schematic diagram of the data collection system that is located within a microchip ball, in accordance with an embodiment of this disclosure.

Looking at FIG. 15, microchip ball 60 is a distributed mobile device and can include memory, a clock, a microprocessor, a communication interface, sensor module, and powering module, encapsulated within a spherical shell. Looking at FIG. 16, when microchip ball 60 is returned to the surface, the data contained on microchip ball 60 can be transferred to a data device 68 by way of receiver 70. Data device 68 can store, analyze, and display the data provided by microchip ball 60.

In certain embodiments, microchip ball 60 can be used to measure and store wellbore information as microchip ball 60 flows to the surface. In such an embodiment, microchip ball 60 can include a microcontroller with a computational module and a memory, a sensor module with a sensor, a power module with a battery, and a communication interface with a download data port for data download. Alternately, such microchip ball 60 can further include an optional downhole data port of the communication interface for downhole data transfer.

In alternate embodiments, microchip ball 60 can be used to carry data to the surface, but does not measure additional data while flowing to the surface. In such an embodiment, microchip ball 60 can include a microcontroller with a computational module and a memory, and a communication interface with a download data port for data download and a downhole data port for downhole data transfer. Alternately, such microchip ball 60 can include a power module with a battery or capacitor for temporary power storage for supporting the data communication before microchip ball 60 is released to flow to the surface.

Figure 18:
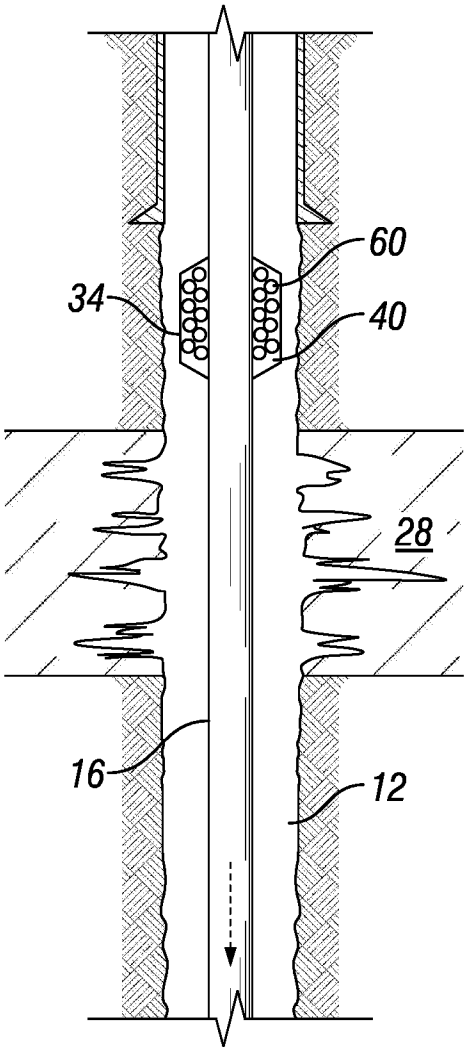
FIG. 18 is a schematic detail section view of a subterranean well with a loss circulation tool, in accordance with an embodiment of this disclosure, shown with microchip balls located in the tool cavity of the tool housing uphole of the loss circulation zone.
Figure 17:
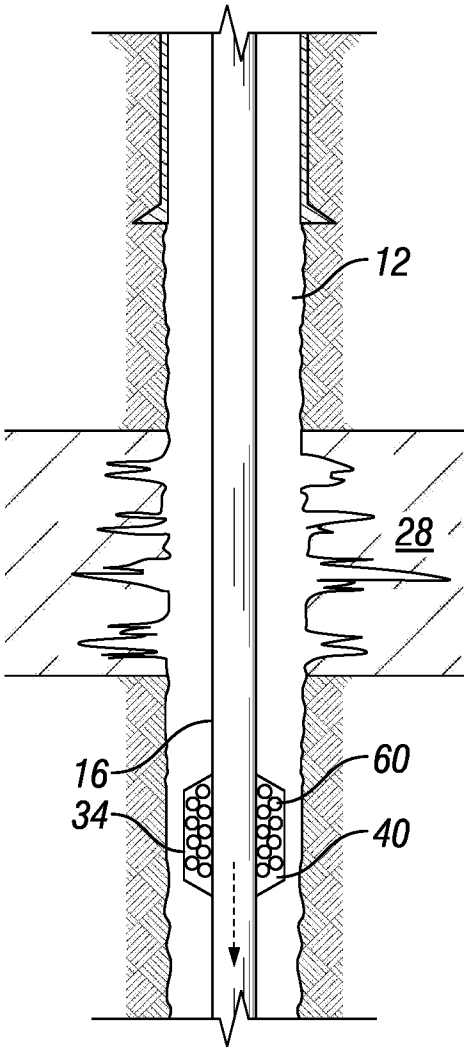
FIG. 17 is a schematic detail section view of a subterranean well with a loss circulation tool, in accordance with an embodiment of this disclosure, shown with microchip balls located in the tool cavity of the tool housing downhole of the loss circulation zone.

Looking at FIG. 17, drill string 16 can be delivered into wellbore 12 and moved in a downhole direction. A number of microchip balls 60 can be located within tool cavity 40 of loss circulation tool 34. When it is determined, through data collected by sensor system 44 (FIG. 5) that loss circulation tool 34 has moved downhole of loss circulation zone 28, then drill string 16 can move axially uphole within wellbore 12. Based on the data received by sensor system 44, drill string 16 can stop moving in a direction uphole when loss circulation tool 34 is uphole of loss circulation zone 28, as shown in FIG. 18. In an embodiment where subterranean well 10 has multiple loss circulation zones 28, loss circulation tool 34 can be moved uphole of the most shallow loss circulation zone 28. This will reduce the risk of microchip balls being drawn into a loss circulation zone instead of being delivered to the surface.

While loss circulation tool 34 is moved through loss circulation zone 28, information and data relating to loss circulation zone 28 and other wellbore data that was collected by sensor system 44 can be stored in microchip balls 60. Such information may include, for example, the depth and severity of loss circulation zone 28. The depth information for each measurement point can be calibrated from the timestamp of the recorded data and the mud flow rate.

Looking at FIG. 19, printed circuit board 42 can actuate release system 54 to move deployment door 52 to the open position (FIG. 5). With deployment door 52 in an open position, microchip balls 60 will exit deployment opening 50 and enter the annulus radially exterior of drill string 16. In the embodiment of FIG. 19, deployment opening 50 extends between tool cavity 40 and the outside of tool housing 36 radially exterior of tubular member 18.

Microchip balls 60 will be carried in a direction with the flow of drilling fluid through the annulus and can be delivered to the surface. The information collected by sensor system 44 can in this way be transferred to the surface using microchip balls 60 as data carriers.

Figure 20:
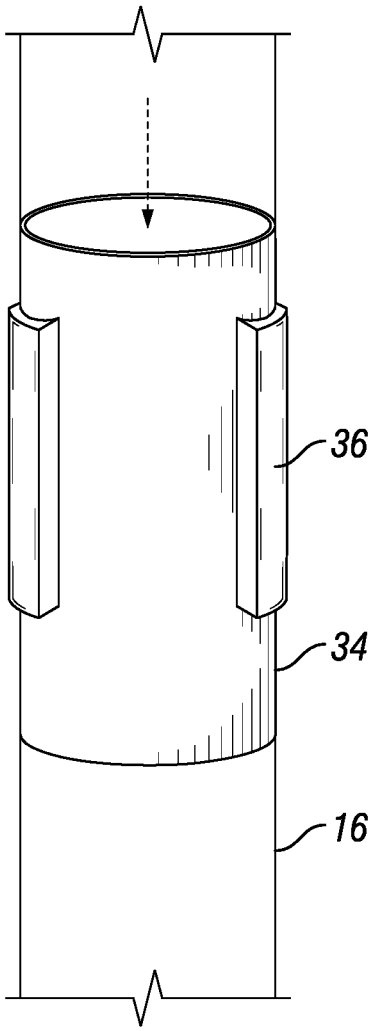
FIG. 20 is a perspective view of a tubular member with a loss circulation tool, in accordance with an embodiment of this disclosure.

In alternate embodiments, looking at FIGS. 20-21, loss circulation tool 34 can be secured inline along drill string 16. Loss circulation tool 34 can be part of a tool sub secured between joints of drill pipe. As shown in FIG. 21, in certain embodiments, deployment opening 50 can extend between tool cavity 40 and the outside of tool housing 36 within a central bore 72 of tubular member 18.

Looking at FIG. 1, while moving through wellbore 12, and in particular, through loss circulation zone 28, information and data relating to loss circulation zone 28 and other wellbore data that was collected by sensor system 44 can be stored in microchip balls 60. Such information may include, for example, the data that can be analyzed or interpreted to determine the depth and severity of loss circulation zone 28.

Looking at FIG. 5, in order to deliver the data that has been stored in microchip balls 60 to the surface, printed circuit board 42 can actuate release system 54 to move deployment door 52 to the open position. With deployment door 52 in an open position, microchip balls 60 will exit deployment opening 50 and enter central bore 72 of drill string 16. In the embodiment of FIG. 21, deployment opening 50 extends between tool cavity 40 and central bore 72 of drill string 16. Microchip balls 60 will travel in a direction downhole through central bore 72, carried by the flow of drilling fluid through central bore 72 of drill string 16.

Looking at FIG. 1, microchip balls 60 can be carried by the flow of drilling fluid through the bit nozzle. Before exiting drill string 16 through the bit nozzle, microchip balls 60 can pass through reader sub 74. Reader sub 74 is part of tubular member 18 and is located downhole of tool housing 36. Microchip balls 60 can flow through an inner diameter of reader sub 74. Reader sub 74 can download the data contained within microchip balls 60. Reader sub 74 can then transfer the downloaded data to the surface, such as through mud pulse telemetry. After passing through the bit nozzle and into wellbore 12, microchip balls 60 can travel to the surface with the flow of drilling fluid.

Figure 16:
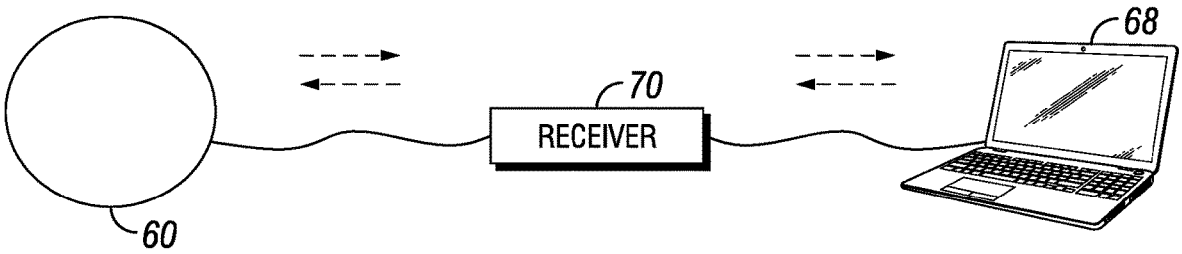
FIG. 16 is a schematic diagram of the data transfer system for a microchip ball, in accordance with an embodiment of this disclosure.

Data stored by microchip ball 60 can also be downloaded at the surface. As an example, any further data that could be stored in microchip ball 60 that was not transmitted to the surface by way of reader sub 74, such as logging data gathered after microchip ball 60 passes through reader sub 74, can be collected by receiver 70 (FIG. 16). For example, in embodiments where microchip ball 60 includes on-board sensors and powering, the logging measurements can be recorded in the memory of the microchip, which can be downloaded at the surface. In this way, microchip ball 60 is able to record and transfer the distribution of the downhole parameters along the entire wellbore 12.

Figure 22:
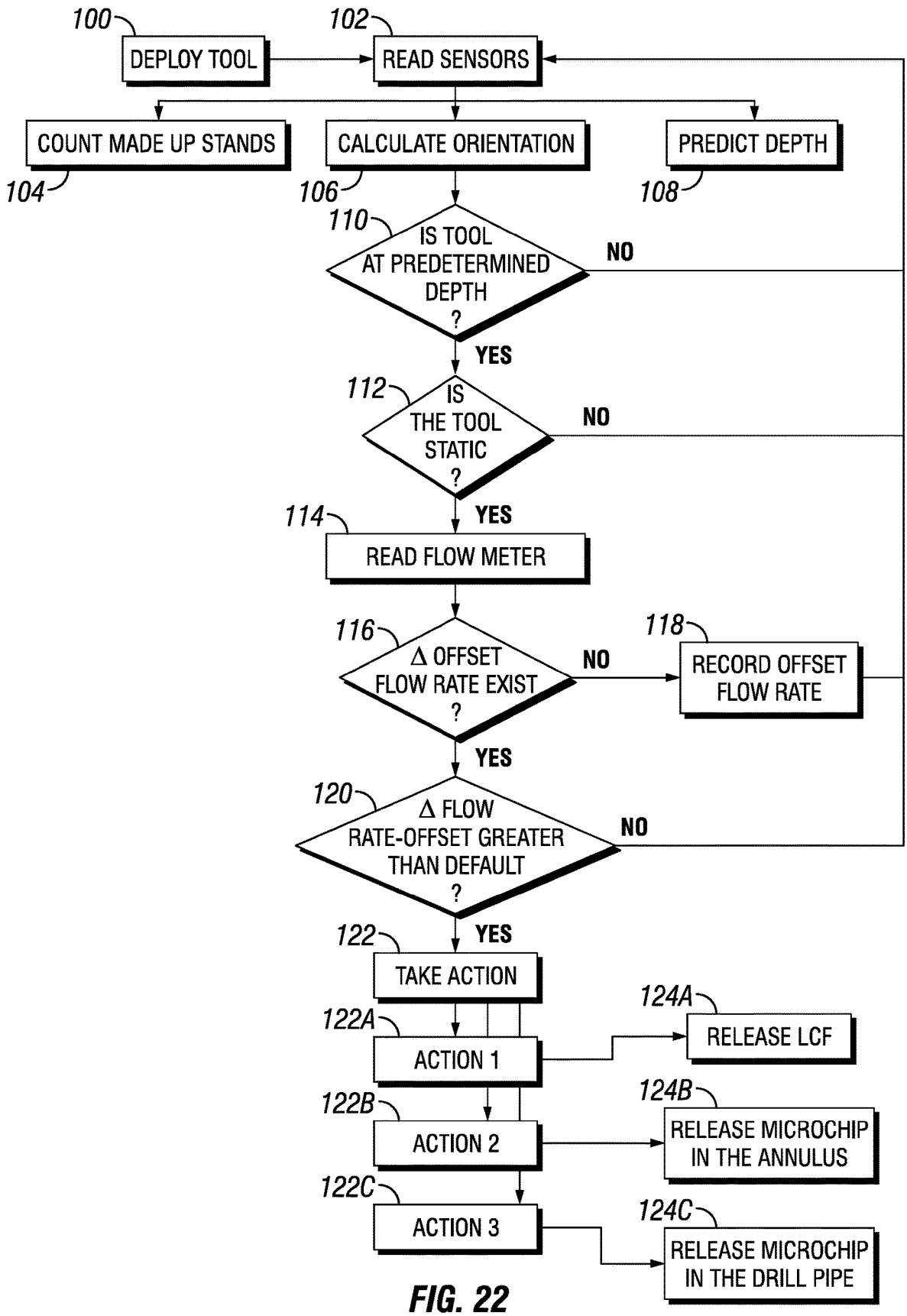
FIG. 22 is a flowchart showing the steps of a method for managing a loss circulation zone in a subterranean well, in accordance with an embodiment of this disclosure.

In an example of operation, before deploying loss circulation tool 34, the electromechanical system of loss circulation tool 34 can be initiated and configured on the surface with the well profile, pre-defined loss zone depth, and well conditions. Loss circulation tool 34 can be made up with tubular member 18 of drill string 16. Looking at FIG. 22, in step 100, loss circulation tool 34 can be deployed into wellbore 12. Loss circulation tool 34 can be deployed as part of drill string 16.

Drill string 16 can be run into wellbore 12 in a direction towards the targeted loss circulation zone 28. While running drill string 16 into wellbore 12, sensor system 44 can detect and collect data relating to conditions within wellbore 12, with sensors that can include a pressure sensor, a temperature sensor, an accelerometer, a magnetometer, and a gyroscope. In step 102, this data can be read and can be evaluated by the electromechanical system of loss circulation tool 34. As an example, in step 104, the accelerometer and gyroscope can be used to count the number of connections made at the surface through transferred vibrations and accelerations. In step 106, data gathered by sensor system 44 can also be used to calculate the orientation of loss circulation tool 34 within wellbore 12.

In step 108, the depth of loss circulation tool 34 within wellbore 12 can be predicted when loss circulation tool 34 is operating in a depth determination mode. The depth of loss circulation tool 34 within wellbore 12 can be predicted from the data gathered by sensor system 44, such as by knowing the number of connections made at the surface and from the orientation of loss circulation tool 34. In addition, temperature and pressure gradients can be measured by sensor system 44 and compared to default values to confirm the depth of loss circulation tool 34 within wellbore 12. Also, the depth of loss circulation tool 34 within wellbore 12 can be correlated by magnetic field measurement of casing joints using magnetic sensors.

In step 110, if the predicted depth of loss circulation tool 34, as determined in step 110, has not reached a pre-determined depth that is uphole of the target loss circulation zone 28, then loss circulation tool 34 can return to step 102 and continue to read sensor system 44 while traveling in a direction downhole within wellbore 12. The pre-determined depth can be programmed into loss circulation tool 34 at the surface before deploying loss circulation tool 34 into wellbore 12, based on the well profile and stored data.

When the predicted depth of loss circulation tool 34 has reached the pre-determined depth that is uphole of the target loss circulation zone 28, as determined in step 110, then loss circulation tool 34 can switch from a depth determination mode to a loss zone recognition mode. In step 112, in loss zone recognition mode, the electromechanical system of loss circulation tool 34 can determine when loss circulation tool 34 is static within wellbore 12. As an example, when making up a joint of the drill string 16 at the surface, or in other cases when drill string 16 is at any static state, the accelerometer can identify that drill string 16 is static.

If it is determined that loss circulation tool 34 is not static, then step 102 can be repeated so that as operations continue, the temperature, pressure and inertial measurements of the locations are continuously recorded regardless of the motion of drill string 16. The inertial measurements of the locations can be measured, for example, with the accelerometer, magnetometer and gyroscope of sensor system 44.

When it has been determined that loss circulation tool 34 is static, a flow meter and other sensors of sensor system 44 can be signaled by the electromechanical system of loss circulation tool 34 to measure and record the flow rate in step 114. The direction of flow, and the location of the measured flow is also measured and recorded. The first set of data that is recorded by the electromechanical system of loss circulation tool 34 in loss zone recognition mode can be recorded as offset data.

In step 116, subsequent data that is measured by loss circulation tool 34 in loss zone recognition mode can be compared to previously data that was measured and recorded as offset data to determine if a currently measured flow rate has a difference or delta (Δ) from the previously recorded offset data value for flow rate. If there is no difference between the currently measured flow rate and the previously recorded offset flow rate, then in step 118 the currently measured flow rate and associated data relating to the location and direction of flow is recorded as offset data. Operations can continue and step 102 can be repeated to continue measuring and recording the temperature, pressure and inertial measurements at the locations of loss circulation tool 34.

If there is a difference between the currently measured flow rate and the previously recorded offset flow rate, then in step 120 the difference or delta can be compared to a pre-determined default delta flow rate. The default delta flow rate can be selected and programmed into loss circulation tool 34 at the surface before deploying loss circulation tool 34 into wellbore 12, based on a value that would indicate a characteristic of the loss circulation zone 28. As an example, the default delta flow rate could be selected to indicate a severity of loss circulation zone 28.

In step 120, if the difference or delta flow rate is less than the pre-determined default delta flow rate, then the currently measured flow rate and associated data relating to the location and direction of flow is recorded as offset data. Operations can continue and step 102 can be repeated to continue measuring and recording the temperature, pressure and inertial measurements at the locations of loss circulation tool 34.

In step 120, if the difference or delta flow rate is equal to or greater than the pre-determined default delta flow rate, then in step 122, an action can be taken. When taking an action, release system 54 can be used to move deployment door 52 between a closed position and an open position. Releasable product 56 can be selected based on which action is determined to be taken.

As an example, if loss circulation zone 28 is to be treated, loss circulation tool 34 that is to be utilized can contain loss circulation fabric 58. Then in step 122A release system 54 can be used to move deployment door 52 between a closed position and an open position so that in step 124A loss circulation fabric (LCF) 58 can be released from loss circulation tool 34.

As an alternate example, if microchip balls 60 are to be released into the annulus, loss circulation tool 34 that is to be utilized can contain microchip balls 60 and can contain deployment opening 50 that extend between tool cavity 40 and the outside of tool housing 36 radially exterior of tubular member 18. Then in step 122B release system 54 can be used to move deployment door 52 between a closed position and an open position so that in step 124B microchip balls 60 can be released from loss circulation tool 34 and into wellbore 12 radially exterior of tubular member 18.

In another alternate example, if microchip balls 60 are to be released into drill string 16, loss circulation tool 34 that is to be utilized can contain microchip balls 60 and can contain deployment opening 50 that extend between tool cavity 40 and the outside of tool housing 36 within a central bore 72 of tubular member 18. Then in step 122C release system 54 can be used to move deployment door 52 between a closed position and an open position so that in step 124C microchip balls 60 can be released from loss circulation tool 34 and into central bore 72 of drill string 16.

Therefore embodiments of this disclosure provide a loss circulation toll that can be installed inline as part of a drill pipe in a distributed fashion and is capable of targeting multiple loss circulation zones. The loss circulation tool can perform as a loss circulation sensing device, and also functions as a downhole stabilizer. The loss circulation tool can either be permanently installed onto the drill pipe, or can be installed as a swappable module into a compartment that is fixed on the outer surface of the drill pipe. The loss circulation tool is capable of autonomously identifying loss circulation zones based on pre-defined and in-situ measured downhole information.

In embodiments of this disclosure, the loss circulation tool can include on-board sensors and can follow a sensing strategy to autonomously evaluate loss circulation situations with optimized power consumption. The loss circulation tool is capable of working as a stand along device to tackle a single loss zone, and is alternately capable of working as distributed devices to manage multiple loss zones. The loss circulation tool can deploy a loss circulation fabric that can be used for loss circulation mitigation. The loss circulation tool can also store microchip balls for downhole data communication of loss circulation information.

In embodiments of this disclosure, the deployment system can automatically release the lost circulation fabricate to mitigate the lost circulation, and can automatically release microchip balls for data communication and logging. The microchip balls can be released into the annulus or into the inside of the drill pipe and transfer the data to the surface through a reader sub and mud pulse telemetry. The drill string can include multiple loss circulation tools and different releasable products can be installed in the loss circulation tools to retrieve loss circulation information as well as to mitigate the losses.

Embodiments described herein, therefore, are well adapted to carry out the objects and attain the ends and advantages mentioned, as well as others inherent therein. While certain embodiments have been described for purposes of disclosure, numerous changes exist in the details of procedures for accomplishing the desired results. These and other similar modifications will readily suggest themselves to those skilled in the art, and are intended to be encompassed within the scope of the present disclosure disclosed herein and the scope of the appended claims.

What is claimed is:

1. A system for managing a loss circulation zone in a subterranean well, the system including:

a tool housing located on a surface of a tubular member, the tool housing having a tool cavity, the tool cavity being an interior open space within the tool housing, where the tool housing is a drill string stabilizer;

an electromechanical system located within the tool cavity, the electromechanical system having a printed circuit board, a microprocessor, a sensor system, a power source, and a communication port assembly;

a release system, the release system operable to move a deployment door of a deployment opening of the tool housing between a closed position and an open position, the deployment opening providing a flow path between the tool cavity and an outside of the tool housing when the deployment door is in the open position, where the release system is actuable autonomously by the electromechanical system; and a releasable product located within the tool cavity, the releasable product operable to travel through the deployment opening when the deployment door is in the open position.

2. The system of claim 1, where the deployment opening extends between the tool cavity and the outside of the tool housing radially exterior of the tubular member.

3. The system of claim 1, where the deployment opening extends between the tool cavity and the outside of the tool housing within a central bore of the tubular member.

4. The system of claim 3, where the tubular member includes a reader sub located downhole of the tool housing.

5. The system of claim 1, where the tool housing is fixed to an outer diameter surface of the tubular member.

6. The system of claim 1, where the releasable product is a lost circulation fabric located within the tool cavity, the lost circulation fabric being releasable out of the tool cavity when the deployment door is in the open position.

7. The system of claim 1, where the releasable product is a plurality of microchip balls located within the tool cavity, the plurality of microchip balls being releasable out of the tool cavity when the deployment door is in the open position.

8. The system of claim 7, where the plurality of microchip balls include a computational module, a memory, a sensor, a battery, and a download data port operable for data download.

9. The system of claim 7, where the plurality of microchip balls include a computational module, a memory, a download data port operable for data download, and a downhole data port operable for downhole data transfer.

10. The system of claim 1, where the communication port assembly includes at least one of a charging port operable for charging of the power source and a data port for transferring data between the electromechanical system and an external device.

11. The system of claim 1, where the tubular member is a joint of a tubular string and the system includes more than one tool housing spaced along a length of the tubular string.

12. A method for managing a loss circulation zone in a subterranean well, the method including:

locating a tool housing on a surface of a tubular member, the tool housing having a tool cavity, the tool cavity being an interior open space within the tool housing, where the tool housing is fixed to an outer diameter surface of the tubular member, the method further including stabilizing the tubular member with the tool housing;

locating an electromechanical system within the tool cavity, the electromechanical system having a printed circuit board, a microprocessor, a sensor system, a power source, and a communication port assembly;

providing a release system, the release system operable to move a deployment door of a deployment opening of the tool housing between a closed position and an open position, the deployment opening providing a flow path between the tool cavity and an outside of the tool housing when the deployment door is in the open position, where the release system is actuable autonomously by the electromechanical system; and positioning a releasable product within the tool cavity, the releasable product operable to travel through the deployment opening when the deployment door is in the open position.

13. The method of claim 12, where the method includes releasing the releasable product through the deployment opening, where the deployment opening extends between the tool cavity and the outside of the tool housing radially exterior of the tubular member.

14. The method of claim 12, where the method includes releasing the releasable product through the deployment opening, where the deployment opening extends between the tool cavity and the outside of the tool housing within a central bore of the tubular member.

15. The method of claim 14, where the tubular member includes a reader sub located downhole of the tool housing, the method further including flowing the releasable product through an inner diameter of the reader sub and downloading data from the releasable product with the reader sub.

16. The method of claim 15, further including transferring the data downloaded by the reader sub to the surface through mud pulse telemetry.

17. The method of claim 12, where the releasable product is a lost circulation fabric located within the tool cavity, the method further including releasing the lost circulation fabric out of the tool cavity when the deployment door is in the open position and positioning the lost circulation fabric across an inner diameter surface of a wellbore of the subterranean well at the loss circulation zone.

18. The method of claim 12, where the releasable product is a plurality of microchip balls located within the tool cavity, the method further including collecting downhole data with the plurality of microchip balls, releasing the plurality of microchip balls out of the tool cavity when the deployment door is in the open position, and delivering the downhole data collected by the plurality of microchip balls to the surface.

19. The method of claim 18, further including measuring wellbore information with the plurality of microchip balls as the plurality pf microchip balls travel from the tool cavity to the surface.

20. The method of claim 12, where the communication port assembly includes a port operable for charging of the power source, and the method further includes charging the power source before delivering the tool housing into the subterranean well.

21. The method of claim 12, where the communication port assembly includes a port for transferring data between the electromechanical system and an external device, and the method further includes initiating and configuring the electromechanical system before delivering the tool housing into the subterranean well.

22. A system for managing a loss circulation zone in a subterranean well, the system including:

a tool housing located on a surface of a tubular member, the tool housing having a tool cavity, the tool cavity being an interior open space within the tool housing;

an electromechanical system located within the tool cavity, the electromechanical system having a printed circuit board, a microprocessor, a sensor system, a power source, and a communication port assembly;

a release system, the release system operable to move a deployment door of a deployment opening of the tool housing between a closed position and an open position, the deployment opening providing a flow path between the tool cavity and an outside of the tool housing when the deployment door is in the open position, where the release system is actuable autonomously by the electromechanical system; and a releasable product located within the tool cavity, the releasable product operable to travel through the deployment opening when the deployment door is in the open position; where the releasable product is a lost circulation fabric located within the tool cavity, the lost circulation fabric being releasable out of the tool cavity when the deployment door is in the open position.

23. The system of claim 22, where the tool housing is located within an outer cavity that is secured to an outer diameter surface of the tubular member.

* * * * *